US005350109A

United States Patent [19]

Brown et al.

[11] Patent Number: 5,350,109

[45] Date of Patent: Sep. 27, 1994

[54] PAPERBOARD CARTON HANDHOLDS

[75] Inventors: Scott B. Brown, London; Hugh A. Maxwell, Ingersoll, both of Canada

[73] Assignee: Labatt Brewing Company Limited, London, Canada

[21] Appl. No.: 27,527

[22] Filed: Mar. 8, 1993

[51] Int. Cl.[5] ..... B65D 5/46

[52] U.S. Cl. ..... 229/117.16; 229/117.13

[58] Field of Search ..... 229/117.13, 117.16, 229/117.17, 40

[56] References Cited

U.S. PATENT DOCUMENTS

| | | | |
|---|---|---|---|
| 2,308,050 | 1/1943 | Burr | 229/117.16 |
| 2,481,871 | 9/1949 | Potts | 229/117.16 |
| 2,586,156 | 2/1952 | Ferguson | 229/117.17 |
| 2,710,135 | 6/1955 | Gaylord . | |
| 2,757,849 | 8/1956 | Duff, Jr. | 229/117.16 |
| 2,768,778 | 10/1956 | Ferguson et al. | 229/117.17 |
| 2,801,786 | 8/1957 | Foster | 229/117.16 |
| 2,865,553 | 12/1958 | Wasyluka | 229/117.17 |
| 4,712,728 | 12/1987 | Schuster | 229/117.13 |
| 4,717,070 | 1/1988 | Taub | 229/117.16 |

FOREIGN PATENT DOCUMENTS

| | | | |
|---|---|---|---|
| 540201 | 4/1957 | Canada | 229/117.17 |
| 650568 | 10/1962 | Canada . | |
| 740309 | 8/1966 | Canada | 229/117.16 |
| 741189 | 8/1966 | Canada | 229/117.16 |
| 1004645 | 2/1977 | Canada . | |
| 1034098 | 7/1978 | Canada . | |

*Primary Examiner*—Gary E. Elkins
*Attorney, Agent, or Firm*—Morgan & Finnegan

[57] ABSTRACT

A carton having an incipient handhold that is adapted to partially break away from surrounding portions of a carton wall, and to sequentially collapse in a predetermined reverse folding or "concertina" fashion, to provide a folded load-bearing handhold structure.

19 Claims, 4 Drawing Sheets

PAPERBOARD CARTON HANDHOLDS

FIELD OF THE INVENTION

The present invention relates to improvements in paperboard carton handholds, and in particular to handholds comprising flaps adapted to be partially broken away from surrounding portions of the paperboard carton wall, to form a comfortable, and strong handhold.

BACKGROUND OF THE INVENTION

Various means have heretofore been proposed for strengthening the end walls of paperboard containers in the regions above the handholds, in the interests of thereby improving the rigidity of the carton and increasing the resistance of the raw edges of the handhold against tearing when the loaded container is held by the handhold(s).

According to CA 1,004645, a handhold is beneficially constructed by having a bi-layered flap fold back on itself, as is shown in FIGS. 5 and 6 of this CA patent. The end result presents a relatively broad, curved surface along the upper reaches of the handhold, to facilitate the comfort of the holder.

U.S. Pat. No. 2,710,135, proposes that an elongated strip of light weight board be affixed above the handhold opening. As shown best in FIGS. 2 and 3 of the U.S. Pat. No. 2,710,135, the strip is adapted to engage the handhold closure flap, once same is broken away from the surrounding paperboard wall. This construction is asserted to reduce the tendency of the raw edges of the handhold to tear. Moreover the construction is claimed to provide a relatively broad smooth surface at the upper edge of the handhold for easier gripping, handling and carrying the container, all without injury to the hand.

CA 1,034,098 discloses a similar construction, wherein the multiple layers of the fibre board subtending the upper edge of the handhold, forces the inwardly bent flap to curve upwardly, in a rounded, easily graspable shape.

CA 740,309 provides a similar construction, but includes a further refinement in which the free, inwardly swinging flap is adapted to abut against the inner surface of the top of the carton. When so engaged, the flap constitutes a diagonal span between the carton top and end walls, and provides a support surface for ease of grasping. Moreover, it is conceivable that at least some of the carton load is thereby distributed to the top panel of the carton, thereby unloading some of the tearing moments that would otherwise act along the end wall panels. This arrangement is best seen in FIG. 5 of this patents drawings.

CA 650,568 discloses a handhold arrangement in which the free edge of the flap is folded by being pressed against the body of an adjacent bottle. As the flap is pushed progressively further into the container, the apex of the bend formed in the flap engages the container, just at or below the container's crown. In this arrangement, the flap bridges between the container engagement and the end wall to provide a more graspable surface, as well as protection for the holder's hand, against scratching along the serration of the bottle crown's skirt.

Despite these and other attempts, however, there remains an unsatisfied need in the art for handhold constructions which lend themselves to user comfort and improve the physical integrity of the carton.

SUMMARY OF THE INVENTION

Broadly speaking, the present invention relates to a handhold for paperboard cartons. In particular, the present invention relates to a carton having an incipient handhold that is adapted to partially break away from surrounding portions of a carton wall, and to sequentially collapse in a predetermined reverse folding or "concertina" fashion, to provide a comfortable folded load-bearing handhold structure.

Accordingly there is provided a paperboard carton having a two layered wall comprising mutually secured interior and exterior layers. These layers are mutually secured along a laterally extending, elongated glue line that is subtended on the exterior layer by an incipient upper hinge line. This wall is adapted to have a handhold formed therein in longitudinally spaced relation below the glue line and the upper hinge line.

The interior layer surrounds an incipient handhold opening that is initially occupied by an interior flap formed from the interior layer, and defined along three of its sides by an interior layer line of relative weakness the ends of which meet at respective ones of opposed ends of an intermediate score line that defines a fourth and upper side of the flap. This score line is adapted to be hingedly deformable.

The exterior layer also surrounds its own incipient handhold opening that is initially occupied by an exterior flap. The exterior flap is defined along three sides by an exterior layer line of relative weakness the opposed ends of which meet at respective ones of opposed ends of an elongated intermediate score line that defines the fourth and upper side of the flap. This fourth side is adapted to be hingedly deformable, too.

These exterior and interior flaps are arranged in mutually co-operable register with the respective interior layer and exterior layer score lines positioned parallel and adjacent to one another in cooperative lower hinge-forming relation.

The interior layer line of relative weakness includes zones of relative intermediate weakness along the respective junctures with corresponding ones of opposed ends of the interior score line, whereby in response to the application of extrinsic laterally applied force against the flaps, the flaps are broken away along the lines of weakness from respective ones of the layers. Once broken away the flaps are free to be rotated inwardly about the lower hinge. Then, in response to subsequent application of extrinsic lifting forces at the handholds, each zone of weakness is torn generally upwardly (i.e. longitudinally) from the corresponding end of the score towards the glue line, to form an enlarged opening and a corresponding nascent, relatively narrower flap, that is intermediate between the glue line and the intermediate score line. This concomitantly frees the nascent flap to rotate outwardly about the upper hinge line and the result is a comfortable handhold formed in the wall of the carton.

According to an even more preferred aspect of the present invention there is provided for a paperboard carton having a handhold, including a handhold flap that is typically generally rectangular, and in any case is adapted to be partially broken away from a surrounding paperboard panel, along pre-determined flap-defining lines of weakness on three sides thereof.

The flap includes, along a fourth, upper side thereof, an incipient, sequentially alternatingly articulated hinge means comprising mutually parallel pair of hinge lines consisting of a lower hinge line and an upper hinge line. The lower hinge line forms an axis of inward rotation about which the flap, upon being broken away from the panel as described above, is initially rotated into the carton's interior. The upper hinge line forms an axis of outward rotation about which the flap is then subsequently rotated into partially withdrawn relation from the carton's interior.

Preferably, a zone of relative weakness extends from respective ones of ends of the upper hinge lines, to corresponding ones of the proximal ends of the lower hinge lines. This zone is relatively stronger than the above mentioned lines of weakness, but relatively weaker than the balance of the paperboard panel. This arrangement thereby facilitates the above referenced outward rotation, by predisposing the panel to tear generally upwardly from the ends of the lower hinge line, towards the vertically corresponding ends of the upper hinge line.

In addition, the flap preferably includes a detent surface adapted to engage against a portion or portions of the carton panel interior to resist further outward rotation or the flap.

A super-positional glue line that is at least coextensive with the upper hinge line is arranged adjacent the upper hinge line. It is preferred that the glue line be located immediately adjacent the upper hinge line. It may, however, be longitudinally spaced, upwardly apart from the upper hinge line by as much as 0.25 or even 0.5 inches, and still provide adequate resistance against unplanned tearing that might compromise handhold panel integrity. In especially preferred embodiments, the glue line extends laterally beyond either end of the upper hinge line, and most preferably all the way to the edges of the handhold-bearing carton panel.

The lower and upper hinge lines are preferably spaced at between about 0.25 and 0.75 inches apart from one another. In exemplary embodiments, the distance separating the two, is about 0.5 inches.

Line of relative weakness 16 is preferably formed by perforating or partially cutting the interior layer 2*a*/2*b* along the edges of the interior flap 13. As a result, the unused flap 13 is connected along the line of relative weakness 16 until sufficient force is applied to break the line of relative weakness 16.

The present invention relates especially to a paperboard carton construction having a two layered wall comprising mutually secured interior and exterior layers. These layers are mutually secured along a laterally extending, elongated glue line subtended on the exterior layer by an incipient upper hinge line. The wall is adapted to have a handhold formed therein in longitudinally spaced relation below the upper hinge line.

As with line of relative weakness 16, line of relative weakness 9 is preferably formed by perforating or partially cutting the exterior layer 2*d* along edges of the exterior flap 3*a*. As a result, the unused flap 3*a* is connected along the line of relative weakness 9 until sufficient force is applied to break the line of relative weakness 9.

The above mentioned interior layer surrounds an incipient handhold opening (or hand hole) that is initially occupied by a generally rectangular interior flap. The interior flap is formed from the interior layer, and is defined along three sides by an interior layer line of relative weakness. That interior layer line of relative weakness extends to a fourth and uppermost side of the interior flap, comprising an intermediate score line, that is adapted to be hingedly deformable. In a preferred embodiment the interior line of weakness extends partially inwardly along the fourth, uppermost side to meet respective ones of opposed ends of that intermediate score line.

The exterior layer surrounds an incipient handhold opening (or hand hole) that is initially occupied by a generally rectangular exterior flap of generally less width than that of the corresponding, underlying, interior flap. The exterior flap is defined along three sides by an exterior layer line of relative weakness that also extends inwardly from both of the adjacent sides along the fourth and uppermost side, to thereby meet at respective ones of opposed ends of an elongated intermediate score line.

The elongated intermediate score line, like its counterpart on the interior layer, is also adapted to be hingedly deformable. More particularly, with both the exterior and interior flaps arranged in mutually co-operable register, the respective interior layer and exterior layer score lines are positioned parallel and adjacent to one another, in mutually-cooperative lower hinge-forming relation.

The interior layer line of relative weakness also includes zones of relative weakness at the junctures with corresponding ones of opposed ends of the interior score line.

In operation, and responsive to the application of extrinsic laterally applied force against the flaps, the flaps are broken away along the above mentioned lines of weakness from respective ones of the layers. The flaps are thereby rotated inwardly about the lower hinge.

Then, in response to subsequent application of extrinsic lifting forces at the handholds, each of the zones of weakness are torn generally upwardly from the corresponding end of the score and towards the glue line. This results in the formation of an enlarged opening and a corresponding nascent, relatively narrower flap, that is located intermediate between the glue line and the intermediate score line. This results in the newly formed flap being concomitantly freed to rotate outwardly about the upper hinge line, whereupon outlying portions of the interior and exterior flaps are engaged in interfering abutting relation against an interior surface of the exterior layer surfaces adjacent the raw edges surrounding the handhold opening (i.e. hand hole) that is formed through the exterior layer.

In particularly preferred embodiments of the present invention, these outlying portions of the interior and exterior flaps are resiliently deformed in interfering abutting relation against exterior layer surfaces adjacent the raw edges that surround the opening through the exterior layer.

The zone of relative weakness may comprise voids having boarders which are adapted to discourage lateral tearing or ripping of the panel material. In a preferred form, the void comprises a circular hole cut completely through the panel material of the interior layer.

DETAILED DESCRIPTION OF A PREFERRED EMBODIMENT

Introduction to the Drawings

FIG. 1 shows a carton assembly according to the present invention, in perspective view, with the end wall assembly presented to show the exterior layer and the incipient handhold flap therein.

FIG. 1*a* illustrates, from an elevated end view of a portion of the carton, the exterior details of a preferred incipient handhold according to the present invention;

FIG. 2 depicts a carton assembly according to the present invention, in perspective view, with the end wall assembly presented with the exterior layer folded back to show the interior layer and the incipient handhold flap therein.

FIG. 2*a* shows an elevated end view of a portion of the carton, and in particular the interior layer details of a preferred incipient handhold according to the present invention;

FIG. 2*b* also shows the super-imposed handhold flap details on the interior and exterior layers;

Figure 1:
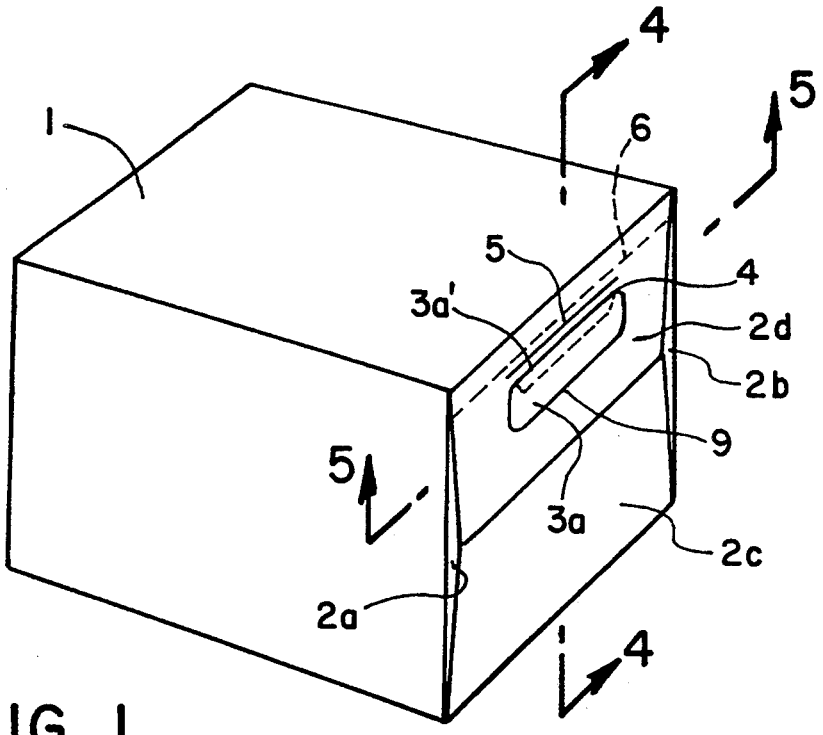
Figure 1A:
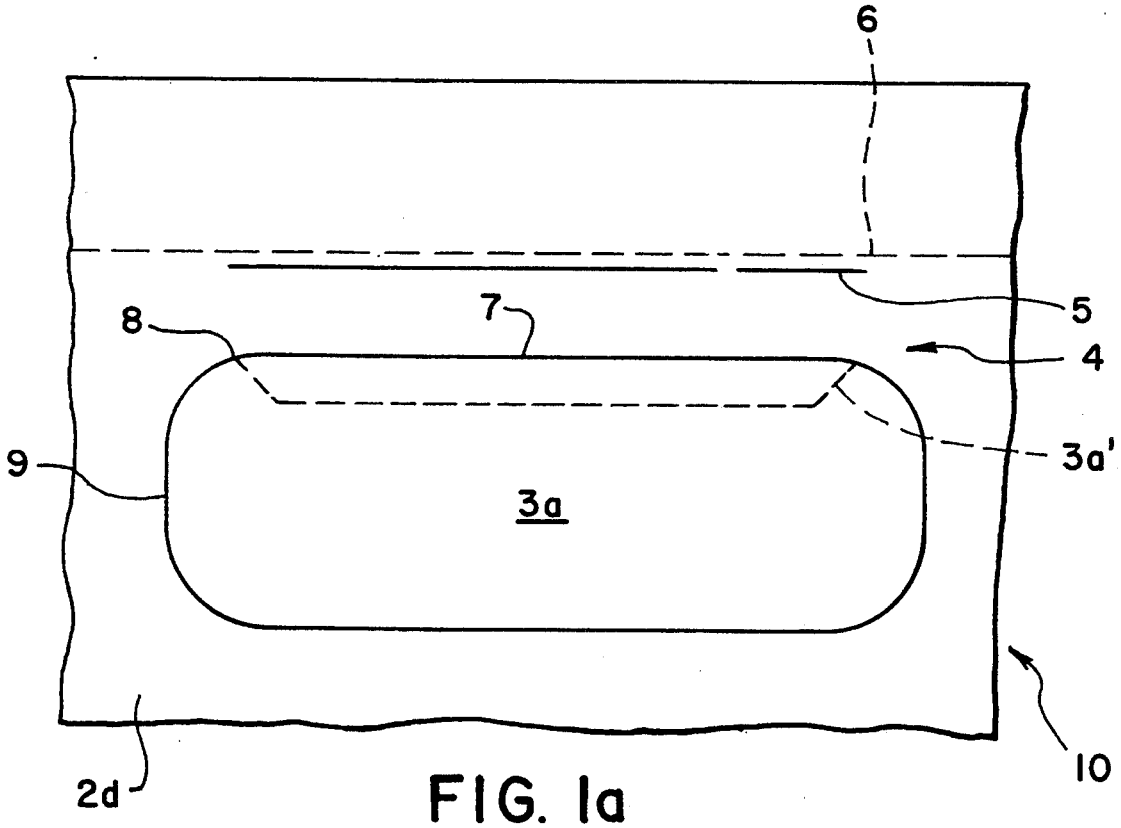
Figure 2:
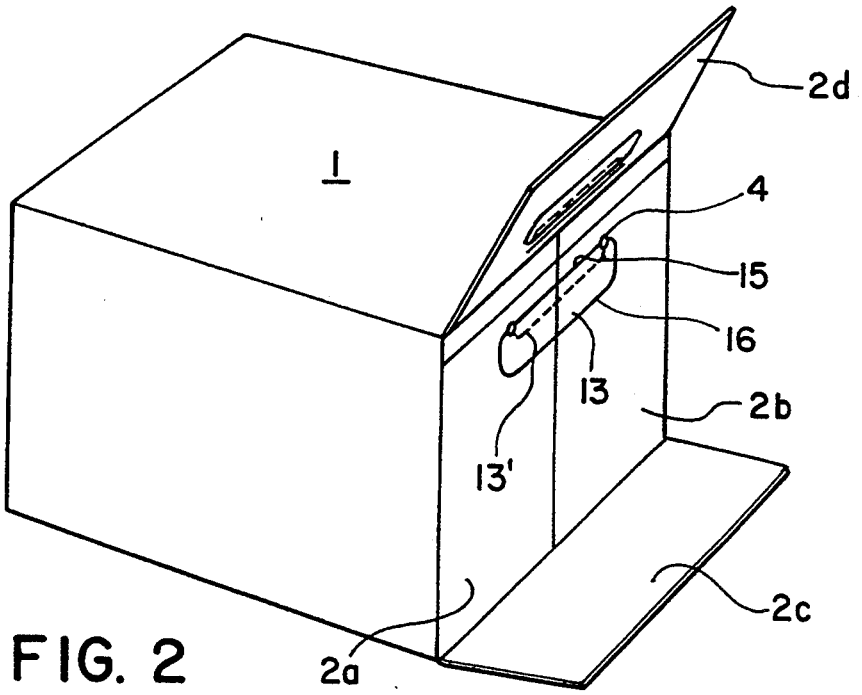
Figure 2A:
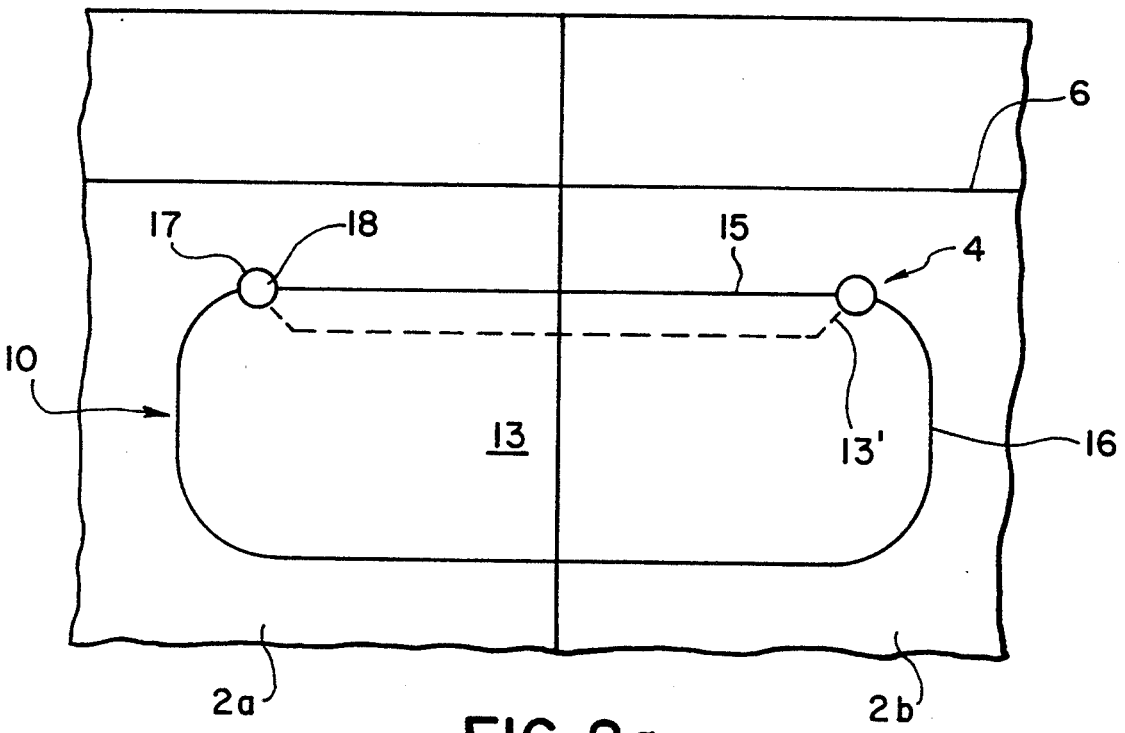
Figure 2B:
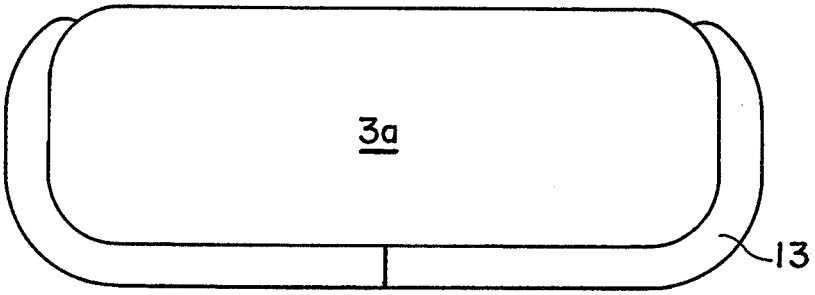
Figure 6:
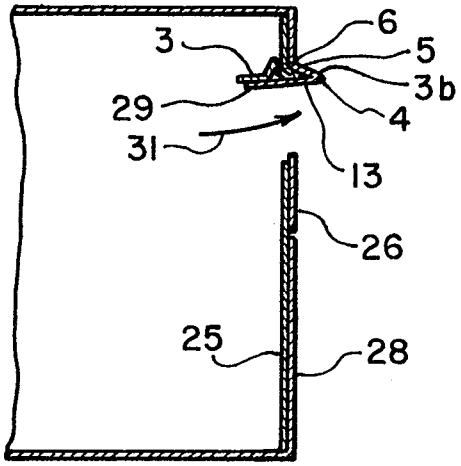
Figure 5:
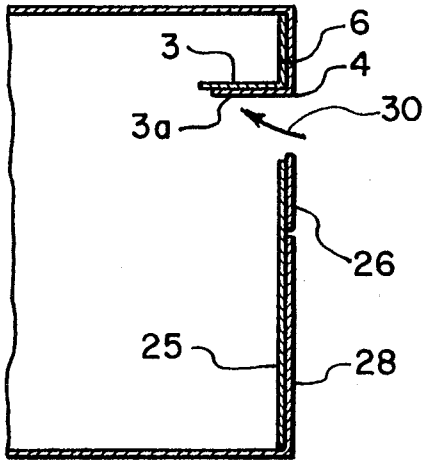
FIG. 5 depicts the first stage of the operation of the present invention, with the inward collapse of the handhold flap, from the same cross sectional perspective that is illustrated in FIG. 4.
Figure 6A:
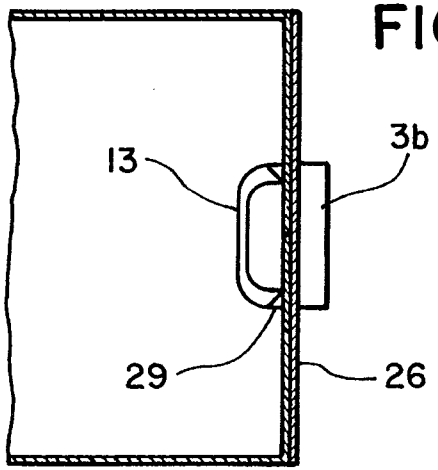
Figure 5A:
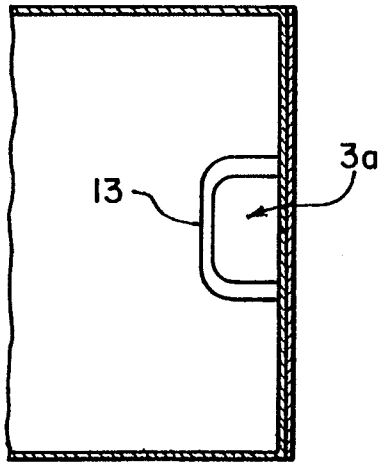

FIG. 5*a* shows a top plan sectional view drawn through section line 5—5 on FIG. 1, to illustrate an alternate view of the depiction of FIG. 5;

FIG. 6 illustrates a second stage of the operation of the present invention, with the outward pulling of a nascent flap through the handhold opening, in the same perspective as shown in FIG. 5; and, FIG. 6*a* depicts a top plan sectional view drawn through section line 5—5 on FIG. 1, to illustrate an alternate view of the depiction of FIG. 6.

Reference to the appended drawings over the course of the following detailed description, will be to the drawings in general, except as may be otherwise indicated by the context in which any particular reference is made.

In a preferred embodiment according to the present invention, a paperboard carton 1 has a two layered composite end wall 2 comprising mutually secured interior and exterior layers, indicated by panel reference numerals 2*d* and 2*a*/2*b*. These layers are mutually secured along a laterally extending, elongated glue line 6, that is subtended on the exterior layer 2*d* by an incipient upper hinge line 5. Wall 2 is adapted to have a handhold opening 10 formed therein in longitudinally spaced relation below the glue line 6 and the upper hinge line 5.

The interior layer 2*a*/2*b* surrounds an incipient handhold opening 10 that is initially occluded by a generally rectangular interior flap 13 formed from the interior layer 2*a*/2*b*, and defined, along three sides thereof, by an interior layer line of relative weakness 16. Line of weakness 16 also extends inwardly from both adjacent sides of the flap 13, along the forth and uppermost side 17, to meet at respective ones of opposed ends on an intermediate score line 15. Score line 15 is adapted to be hingedly deformable.

The exterior layer 2*d* surrounds an incipient handhold opening 10 that is covered by a generally rectangular exterior flap 3*a* of generally less width than that of the corresponding interior flap 13. The exterior flap 3*a* is defined along three sides by an exterior layer line of relative weakness 9. Line of relative weakness 9 also extends inwardly from both of the adjacent sides along the fourth and uppermost side to meet at respective ones of opposed ends of an elongated intermediate score line 7. Score line 7 is also adapted to be hingedly deformable.

The exterior and interior flaps 3*a*, 13 are arranged in mutually co-operable register with the respective interior layer and exterior layer score lines 7, 15 positioned parallel and adjacent to one another to cooperatively form a lower hinge 4.

The interior layer line of relative weakness 16 includes zones of relative intermediate weakness 18 along the respective junctures with corresponding ones of opposed ends of the interior score line 15.

FIGS. 1, 1*a*, 2 and 2*a*, the flaps 3*a*, 13 are shown in their connected positions. In response to the application of extrinsic laterally applied force against said flaps 3*a*, 13, they are broken away along said lines of relative weakness 9, 16 from respective ones of the layers 2*d*, 2*a*/2*b*, and rotated (see the directional arrow marked with reference numeral 30) inwardly about the lower hinge 4. The inwardly rotated unconnected positions of the flaps 3*a*, 13 are respectively shown by broken lines 3*a*′, 13′ in FIGS. 1, 1*a*, 2 and 2*a*.

Responsive to subsequent application of extrinsic lifting forces at the handhold, each of the zones of weakness 18 is torn generally upwardly from the corresponding end of the score 15 towards the glue line 6, to facilitate the formation of an enlarged opening and a corresponding nascent, relatively narrower flap 3*b*, from intermediate between the glue line 6 and the intermediate score lines 7,15. This concomitantly frees the nascent flap 3*b* to rotate (see the directional arrow indicated by reference numeral 31), outwardly about the upper hinge line 5. At the same time outlying portions 29 of the interior flap 13 are engaged in interfering abutting relation against exterior layer surfaces adjacent raw edges surrounding the opening 10 through the exterior layer 2*d*. In particular, note that in the illustrated embodiment, the outlying portions 29 of said interior and exterior flaps are resiliently deformed in interfering abutting relation against those exterior layer surfaces. That and the fact that the rectangular flaps have substantially radiused corners gives the handhold a comfortable resilient feel, without compromising a holder's impression of the carton's strength.

Zones of weakness 18, in the illustrated embodiment, are punch holes extending through the composite interior layer 2*a*/2*b*. The holes can be from about 0.125 to 0.375 inches in diameter, and are preferably about 0.1875 inches in diameter, and each has relatively smooth edges that reduce the predisposition towards tearing in the lateral direction.

Figure 3:
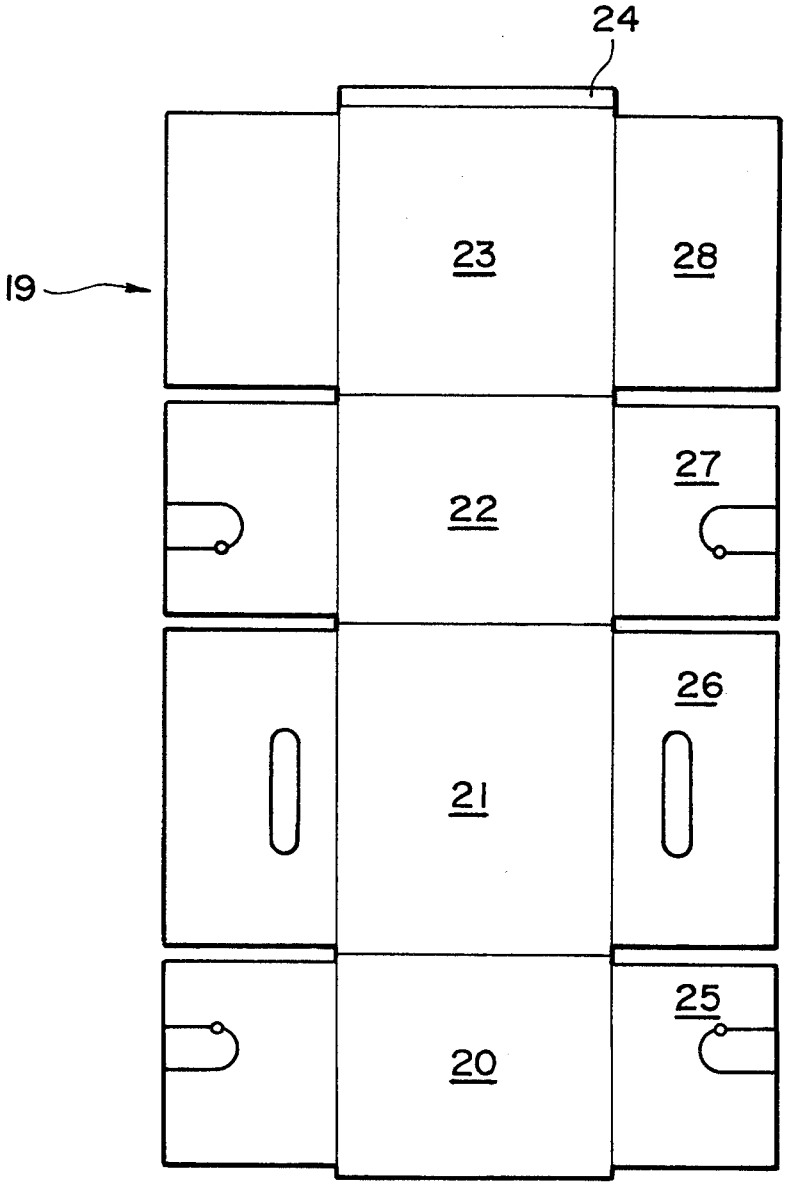
FIG. 3 illustrates a web, useful in the practice of the present invention, for assembly into a carton as illustrated in the balance of the appended drawings.

Referring now in particular to FIG. 3 of the drawings, there is depicted a carton blank 19, comprising a paperboard web comprising a plurality of contiguous panels joined through various fold lines. In particular, there is provided side panels 20, 22, a top panel 21, and a bottom panel 23. Also included is a glue tab 24 that is adapted to be glued to side panel 20, when the carton is initially formed up as a sleeve. In addition, the web includes mutually opposed sets of end panels. Each end panel comprises top and bottom end panels 2d and 2c, as well as an opposed pair of side end panels 2a and 2b. These are adapted to be folded into a two layered composite end wall structure, generally as described elsewhere herein.

Figure 4:
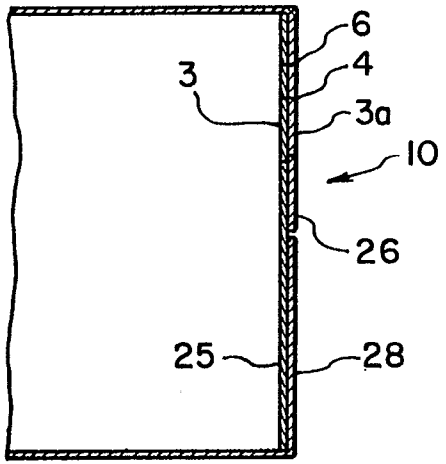
FIG. 4 is a sectional elevated view, taken along line 4—4 of FIG. 1, to show a cross-section through the cooperatively aligned interior and exterior layers respective handhold flaps.

Turning next to FIGS. 4, 5, 5a, 6 and 6a, there is depicted the sequential operation of the present invention, beginning with FIG. 4, and the incipient handhold opening 10 fully covered by the flaps 3a and 13.

When extrinsic forces are applied against the exterior surface of exterior flap 3a, the flaps break away along their respective lines of weakness, and pivot inwardly around the lower hinge line 4, as generally indicated by the directional arrow marked with reference numeral 30. This extrinsic force is typical of the moments that would be applied by a person grasping the carton along the top edge, with fingers extending downwardly along the end panel, in register with the incipient opening, and pressed inwardly in a grasping motion.

When the person begins to exert a lifting force, that force translates initially as an outward and upward force along the upper edge of the now open handhold. This has the effect of partially breaking flap 3a outwardly and away from the surrounding composite end wall, which in turn pulls flap 3a partially through the opening 10. As flap 3a is pulled through opening 10, larger dimensions of flap 13 are ploughed up as outlaying portions 29, against the interior surface of the exterior panel 2d. This wedgingly stabilizes the handhold grip, and the resilient "give" of the paperboard material in the deformed portions provides a degree of comfort for the carton's holder.

Note that although the forgoing carton embodiment is adapted only to provide a single nascent flap, it is clearly within the scope of the present teachings to provide alternate embodiments in accordance with the spirit of the present invention. This and other aspects of the present invention will be apparent to the person skilled in the art on reading of the present specification.

We claim:

1. A paperboard carton having a two layered wall comprising mutually secured interior and exterior layers mutually secured along a laterally extending, elongated glue line subtended on the exterior layer by an incipient upper hinge line, said wall being adapted to have a handhold formed therein in longitudinally spaced relation below said glue line and said upper hinge line; and, wherein:

said interior layer surrounds an incipient handhold opening that is covered by a generally rectangular interior flap formed from said interior layer, said interior flap is defined along a first lateral side, a second lateral side and third lowermost side by an interior layer line of relative weakness that also extends inwardly from said first lateral side and said second lateral side along a fourth uppermost side of said interior flap, to meet at respective opposed ends of an intermediate score line located along said fourth uppermost side and adapted to be hingedly deformable; and, wherein said exterior layer surrounds an incipient handhold opening that is covered by a generally rectangular exterior flap of generally less width than that of said interior flap, said exterior flap being defined along a first lateral side, a second lateral side and a third lowermost side by an exterior layer line of relative weakness that also extends inwardly from said first lateral side and said second lateral side along a fourth uppermost side of said exterior flap to meet at respective opposed ends of an elongated intermediate score line located along said fourth uppermost side and adapted to be hingedly deformable; and wherein, said exterior and interior flaps are arranged in mutually co-operable register with the respective interior layer and exterior layer intermediate score lines positioned parallel and adjacent to one another in cooperative lower hinge-forming relation; and wherein, said interior layer line of relative weakness includes zones of relative intermediate weakness along respective junctures with corresponding opposed ends of said interior layer intermediate score line; and whereby, in response to application of extrinsic laterally applied force against said flaps, said flaps are respectively broken away along said lines of relative weakness from exterior and interior said layers, and rotated inwardly about said lower hinge; and whereby, in response to subsequent application of extrinsic lifting forces at said handholds, each said zone of weakness is torn generally upwardly from the corresponding end of the interior layer intermediate score line toward the glue line, to form an enlarged opening and a corresponding nascent, relatively narrower flap, intermediate between said glue line and said exterior layer and interior layer intermediate score lines, and concomitantly freeing nascent flap to rotate outwardly about said upper hinge line, whereupon outlying portions of said interior flap are engaged in interfering abutting relation against exterior layer surfaces adjacent raw edges surrounding said opening through said exterior layer.

2. The carton according to claim 1 wherein said outlying portions of said interior and exterior flaps are resiliently deformed in interfering abutting relation against exterior layer surfaces adjacent said raw edges surrounding said handhold opening through said exterior layer.

3. The carton according to claim 2 wherein said generally rectangular interior and exterior flaps have substantially radiused corners.

4. The carton according to claim 3 wherein said zones of weakness are punch holes extending through said interior layer.

5. The carton according to claim 4 wherein said holes are from about 0.125 to 0.375 inches in diameter.

6. The carton according to claim 5 wherein said holes are from about 0.1875 inches in diameter.

7. The carton according to claim 2 wherein said interior layer comprises overlapping lateral carton end flaps, and said exterior layer comprises a vertical carton end flap arranged in superposed relation over said overlapping carton end flaps.

8. A carton blank to be assembled into a carton, and comprising a contiguous web of paperboard cut and scored to provide, in the assembled carton, two mutually opposed side walls, two mutually opposed end wall assemblies, a bottom forming panel and a top forming panel; and wherein each end wall assembly comprises a plurality of end wall panels to be assembled in partially overlapping generally two-layered relation, and originating, respectively, from the opposed side walls, the forming panel and the bottom forming panel; and, wherein the end wall assembly of said carton includes a handhold extending through overlapping portions of the end wall panels, wherein the end wall panels are assembled such that the end wall assembly comprises mutually secured interior and exterior layers mutually securable along a laterally extending, elongated glue line subtended on the exterior layer by an incipient upper hinge line, the end wall assembly having a handhold formed therein in longitudinally spaced relation below the glue line and the upper hinge line; and, wherein:

the interior layer surrounds an incipient handhold opening that is covered by a generally rectangular interior flap formed form the interior layer, the interior flap being defined along a first lateral side, a second lateral side, and a third lowermost side by an interior layer line of relative weakness that also extends inwardly from the first lateral side and the second lateral side along a fourth uppermost side of said interior flap, to meet at respective ones of opposed ends of an intermediate score line located along said fourth uppermost side and adapted to be hingedly deformable; and, wherein the exterior layer surrounds an incipient handhold opening that is covered by a generally rectangular exterior flap of generally less width than that of the interior flap, the exterior flap being defined along a first lateral side, a second lateral side and a third lateral side by an exterior layer line of relative weakness that also extends inwardly from the first lateral side and the second lateral side along a fourth uppermost side of said exterior flap to meet at respective ones of opposed ends of an elongated intermediate score line located along said fourth uppermost side and adapted to be hingedly deformable; and wherein, the exterior and interior flaps are to be arranged in mutually co-operable register with the respective interior layer and exterior layer intermediate score lines positioned parallel and adjacent to one another in cooperative lower hinge-forming relation; and wherein, the interior layer line of relative weakness includes zones of relative intermediate weakness along respective junctures with corresponding opposed ends of the interior layer intermediate score line; and whereby, the assembly is responsive to application of extrinsic laterally applied force against the flaps, such that the flaps are broken away along the lines of relative weakness from the exterior and interior layers, and are rotatable inwardly about the lower hinge; and whereby, the assembly is further responsive to subsequent application of extrinsic lifting forces at the handholds, whereby each of the zones of relative weakness are torn generally upwardly from the corresponding end of the interior layer intermediate score line toward the glue line, to form an enlarged opening and a corresponding nascent, relatively narrower flap, intermediate between said glue line and said interior layer and exterior layer intermediate score lines, and concomitantly freeing the nascent flap to rotate outwardly about the upper hinge line, whereupon outlying portions of the interior flap engage in interfering abutting relation against exterior layer surfaces adjacent raw edges surrounding said opening through said exterior layer.

9. The carton blank according to claim 7 wherein the generally rectangular interior and exterior flaps have substantially radiused corners.

10. The carton blank according to claim 9 wherein the zones of weakness are punch holes extending through the interior layer.

11. The carton blank according to claim 10 wherein the punch holes are from about 0.125 to 0.375 inches in diameter.

12. The carton blank according to claim 11 wherein said holes are from about 0.1875 inches in diameter.

13. A paperboard carton having a handhold:

including a generally rectangular handhold flap adapted to be partially broken away along predetermined flap-defining lines of relative weakness on three sides thereof, from a surrounding paperboard panel; and, including along a fourth side thereof, an incipient, sequentially alternatingly articulated hinge means for permitting the articulation of said handhold flap, said hinge means comprising a pair of parallel hinge lines consisting of a lower hinge line structurally connected to an upper hinge line for permitting multiple articulation of said handhold flap and wherein:

said lower hinge line forms an axis of inward rotation about which said flap, upon being broken away from said panel, is initially rotated into an interior space defined by said carton; and, said upper hinge line forms an axis of outward rotation about which said flap is subsequently rotated into partially withdrawn relation from said interior space, and wherein said flap includes a detent surface adapted to engage against said panel in further outward rotation resisting relation.

14. The carton according to claim 13 wherein a super-positional glue line that is at least coextensive with the upper hinge line is arranged adjacent said upper hinge line.

15. The carton according to claim 14 wherein said glue line extends laterally beyond either end of said upper hinge line.

16. The carton according to claim 14 wherein said lower and upper hinge lines are spaced at between about 0.25 and 0.75 inches apart from one another.

17. The carton according to claim 16 wherein the distance separating said upper and lower hinge lines, is about 0.5 inches.

18. The carton according to claim 17, wherein a zone of relative weakness extends between proximal ends of the upper and lower hinge lines, which zone is relatively stronger than said lines of relative weakness, but relatively weaker than the paperboard panel, to thereby facilitate said outward rotation by predisposing the panel to tear generally upwardly from the ends of the lower hinge line, towards vertically corresponding ends of the upper hinge line.

19. A paperboard carton having a two layered wall comprising mutually secured interior and exterior layers mutually secured along a laterally extending, elongated glue line subtended on the exterior layer by an incipient upper hinge line, said wall being adapted to have a handhold formed therein in longitudinally spaced relation below said glue line and said upper hinge line; and, wherein:

said interior layer surrounds an incipient handhold opening that is initially occupied by an interior flap formed from said interior layer, said interior flap defined along a first lateral side, a second lateral side, and a third lowermost side by an interior layer line of relative weakness that meets respective opposed ends of an intermediate score line that defines a fourth upper side of said interior flap and is adapted to be hingedly deformable; and, wherein said exterior layer surrounds an incipient handhold opening that is initially occupied by an exterior flap, said exterior flap being defined along a first lateral side, a second lateral side, and a third lateral side by an exterior layer line of relative weakness that meets respective opposed ends of an elongated intermediate score line that defines a fourth upper side of said exterior flap and is adapted to be hingedly deformable; and wherein, said exterior and interior flaps are arranged in mutually co-operable register with said respective interior layer and exterior layer intermediate score lines positioned parallel and adjacent to one another in cooperative lower hinge-forming relation; and wherein, said interior layer line of relative weakness includes zones of relative intermediate weakness along respective junctures with corresponding opposed ends of said interior layer intermediate score line; and whereby, in response to the application of extrinsic laterally applied force against said flaps, said flaps are respectively broken away along said lines of relative weakness from said exterior and interior layers, and rotated inwardly about said lower hinge; and whereby, in response to subsequent application of extrinsic lifting forces at the handholds, each said zone of weakness is torn generally upwardly from the corresponding end of the interior layer intermediate score line toward the glue line, to form an enlarged opening and a corresponding nascent, relatively narrower flap, intermediate between said glue line and said interior layer and exterior layer intermediate score lines, and concomitantly freeing said nascent flap to rotate outwardly about said upper hinge line.

* * * * *